United States Patent [19]

Gibson

[11] 4,205,446

[45] Jun. 3, 1980

[54] DRESS PATTERN

[76] Inventor: Donald A. Gibson, 2940 Pease Dr., Rocky River, Ohio 44116

[21] Appl. No.: 913,858

[22] Filed: Jun. 8, 1978

[51] Int. Cl.[2] ..... A41H 1/00

[52] U.S. Cl. ..... 33/12; 33/17 R; 33/17 A

[58] Field of Search ..... 33/12, 14, 16, 17 R, 33/17 A, 11

[56] References Cited

U.S. PATENT DOCUMENTS 1,256,029 2/1918 McClaughry 33 ..... 11/

*Primary Examiner*—Willis Little

*Attorney, Agent, or Firm*—Fay & Sharpe

[57] ABSTRACT

A dress pattern adapted from a master pattern that is of variable size and has a bodice section and a skirt section which are separate but adjacent one another. The pattern is based on the concept of graded measurements at the periphery of the pattern. With the exception of the center front section, the pattern is characterized by having a center front section, a front neckline, a shoulder seam, a front armhole, an underarm seam and a bust dart. The skirt section itself is characterized by the addition of graded measurements on each section.

4 Claims, 4 Drawing Figures

10
11
12
13
14
15
16
16'
17
17'
18
19
20
22
23
28
32
35
37
40
41
42
43
44
45
46
47
48
49
50
51
54
55

DRESS PATTERN

BACKGROUND OF THE INVENTION

Over a long period of time in the art of home sewing, dressmaking and/or pants making, patterns were developed and used in a variety of standard sizes. There is known, however, a variable sized pattern but one in which a standard-size pattern still must be used and then graded to the individual measurements of the proposed wearer. Magic Fit is an example of a variable-size pattern. It may be considered broadly similar inasmuch as it employs a master pattern and incorporates graded measurements in a pattern fit to a proposed user. There are many differences over the instant invention, but one principal distinction is that the Magic Fit pattern allows for no built-in seam allowances. Furthermore, the graded measurements are placed on all sides of the Magic Fit pattern, whereas the present invention provides for graded measurements from fixed front and/or back portions. Magic Fit also uses a bustline dart marker which is merely a technique for locating the bustline dart, whereas in the present invention it is built right into the pattern.

BRIEF DESCRIPTION OF THE INVENTION

In accordance with the present invention, a dress pattern may be made from a master pattern which includes all the required parts for making a dress as well as taking into account all possible alternatives of patterning.

In general, then, a tissue pattern may be made from a master pattern by drawing the pattern along graded measurement marks. Later the pattern is transferred onto a nylon fabric material or onto some permanent fabric pattern or working pattern.

The pattern of this invention is characterized in that it incorporates ease and seam allowances of one-half inch with the neckline seam permitting one-quarter inch allowance. Further, the pattern is characterized in its greater simplicity of handling and combines straight edges and curves for connecting various portions of graded measurements in a manner not heretofore known.

BRIEF DESCRIPTION OF THE DRAWINGS

Details of the preferred embodiment of this invention are described in detail in this specification and are illustrated in the accompanying drawings which form a part hereof, wherein.

MEASUREMENTS

Figures 1, 2:
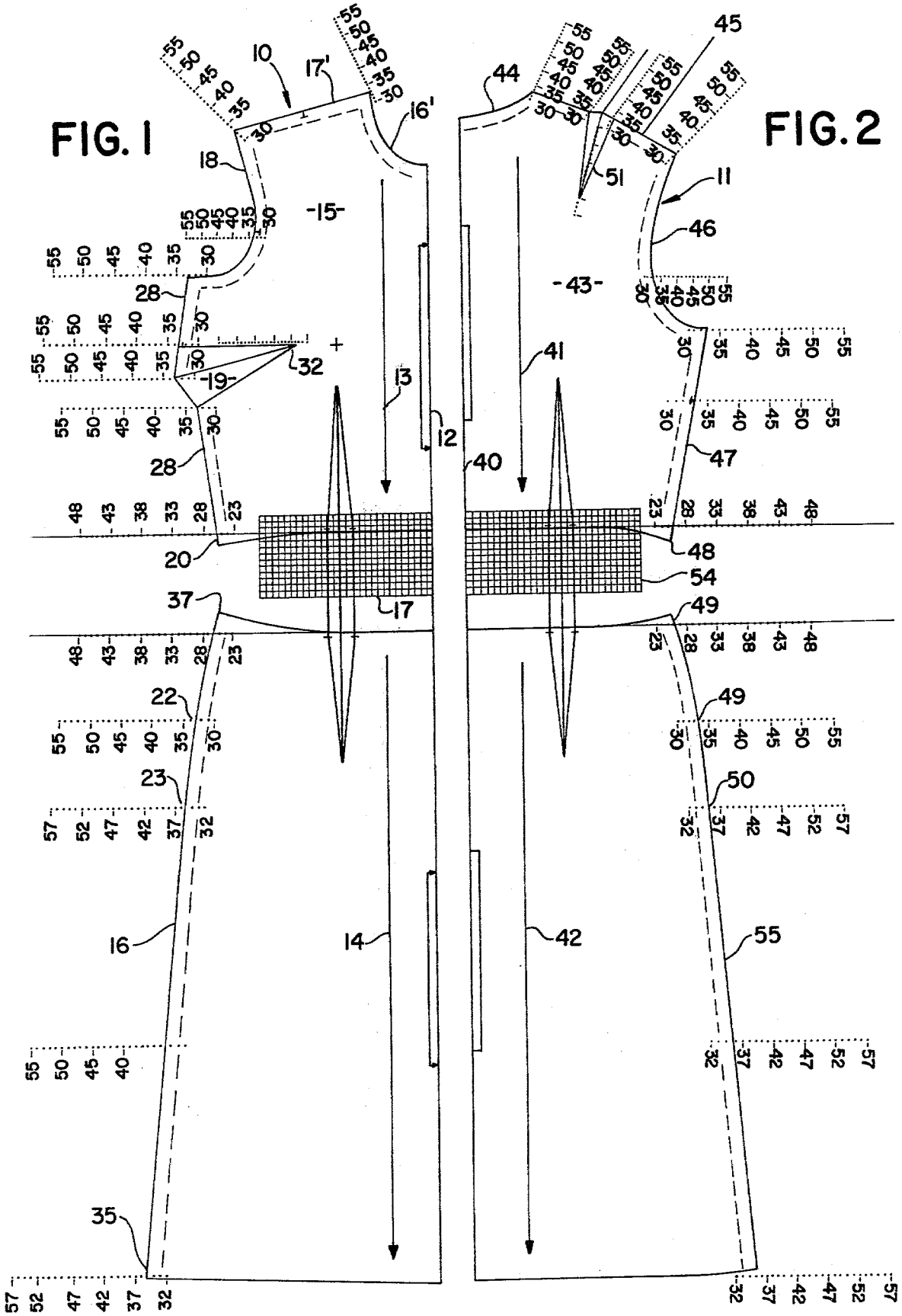
FIG. 1 is a plan view of the front master pattern.
FIG. 2 is a plan view of the back master pattern.
Figure 3:
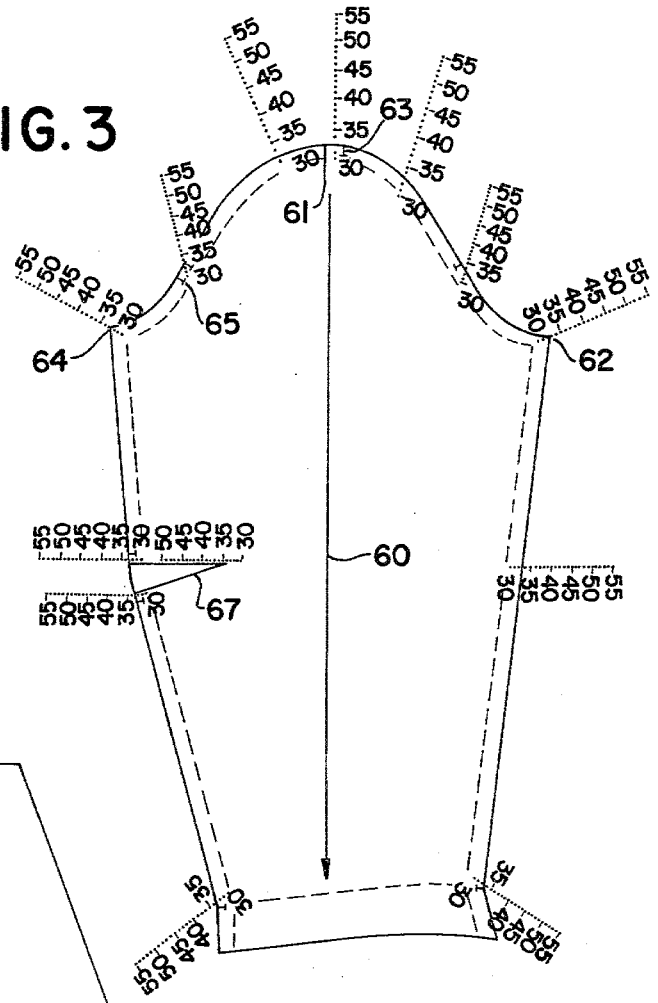
FIG. 3 is a plan view of the sleeve pattern.

For the reason that correct measurements are essential to a well-fitting pattern, there follow descriptions and definitions to permit an understanding of this invention:

Bust: Measure around the back at the fullest part of the bust using a tape measure that is parallel to the floor.

Waistline: Place a narrow belt ribbon or elastic strip comfortably around the waist and measure where this belt ribbon or elastic strip finds its natural waistline.

High Hip: A high hip measurement is made approximately 3 inches below the natural waistline. Here again, the tape measure is parallel to the floor.

Widest Hip: Measure the widest hip around the fullest part of a hip, approximately 7–9 inches below the natural waistline.

Front Shoulder Seam to Waistline: With the tape measure placed at the top of the shoulder, approximately 2 inches out from the base of the neck, bring the tape over the fullest part of the bust and down to the natural waistline.

Front Shoulder Seam to Hem: With one end of the tape measure at the top of the shoulder, approximately 2 inches out from the base of the neck, bring the tape over the fullest part of the bust, and, holding the tape at the waistline, continue to measure from the waist to the desired hemline.

Shoulder to Elbow: Place the end of the tape at the edge of the shoulder bone and measure from the length of the upper arm to the elbow.

Arm Length: Place the end of the tape at the edge of the shoulder bone and measure arm length over a slightly bent elbow to the wrist bone.

Pivot Point to Pivot Point: Measure the distance between bust pivot points and then divide this measurement in half.

DESCRIPTION OF THE PREFERRED EMBODIMENT

Referring now to the drawings wherein the showings are for purposes of illustrating the preferred embodiment of the invention only and not for purposes of limiting same, the figures concern the following:

The present invention is directed to a dress pattern of variable size which may be produced from an improved master pattern and one from which a person may properly choose the required dress dimensions.

Further, it is an object of this invention to provide for a simplified technique of making a dress pattern whereby it is relatively foolproof and good fitting when completed.

Figure 4:
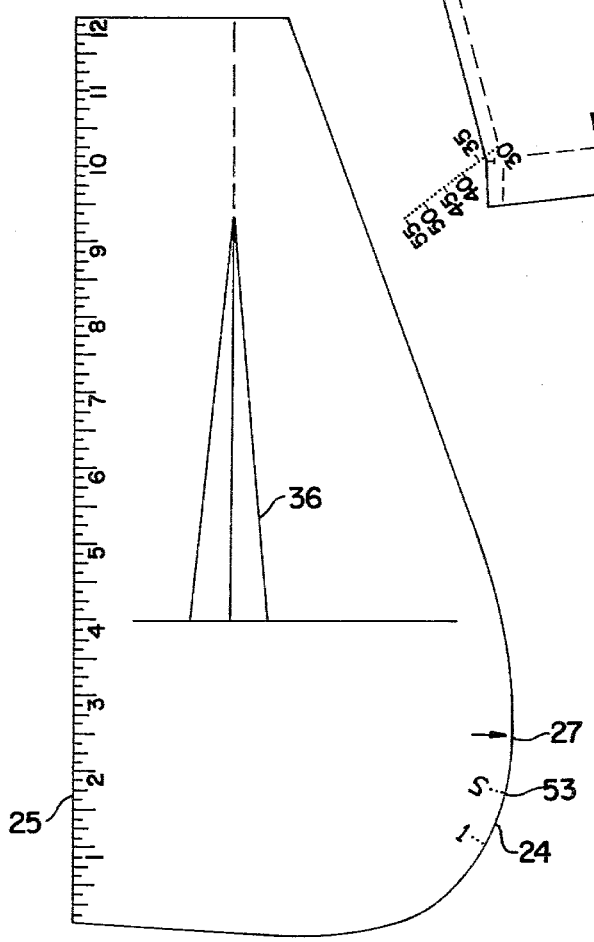
FIG. 4 is a plan view of the straight edged and curved drawing tool.

With respect to the requirements and procedural steps in producing the pattern of this invention, it is first necessary to lay out the front master pattern 10 onto a hard surface. Note, of course, the back master pattern 11. A tissue is placed over the master pattern, and a line is drawn along the center front 12 with a straight-edge tool which is supplied with the dressmaking kit. The center front is thus marked so that it may be cut on the fold. Then draw in the grain lines 13 and 14 for both the bodice section and skirt section of the master pattern. The pattern has two distinct sections—the bodice section 15 and skirt section 16—which are separated only a short distance apart. A grid pattern 17 (to be more fully explained) is shown at the base of the bodice portion. The top of the front bodice is laid out in accordance with the bust measurement around the neckline 16' through front seam 17', to the front armhole 18 and down to the bust dart area 19. By continuing to mark down to the waistline, the measurement shifts then to waistline 20. On the skirt section 16 the graded measurements are identified as the high hip line 22, below this point at the widest hip 23 and down to the hemline. The measurement to be used is the widest hip after the graded measurement marks are identified and marked. These points are connected and starting with the neckline 16' from the center front section 12, the curve edged tool 24 is used (see FIG. 4) to draw the front neckline in one step.

Shifting to the straight edged tool 25, a line is drawn from the neckline along the shoulder seam to connect the marked dots. The shoulder notch 26 is, of course, also marked on the tissue. The front armhole 18 is drawn in two steps: Draw the top front armhole by placing the arrow 27 of the curve at the armhole grid and then align the curve to connect dots from said grid to the shoulder seam 17'. Draw the bottom of the front armhole by moving the curve to line up the section marked No. 1 at armhole grid, and then align the curve to connect dots from the grid to the underarm seam 28. Note that there are specific graded measurements on the armhole for more accurate drawing of the curve.

The next step is to draw the side seam or underarm seam 28 with the straight edged tool 25 from the underarm to the first mark or dot on the bust dart 19. Following this procedure, four dots are drawn for the bust dart, 3 on the periphery of the pattern and 1 to represent the graded mark in the center of the pattern 32, adjacent to the pivot point 33. The pivot point is established by a fixed measurement amount, i.e. 1¼ inches out from the end of the bust dart.

To establish the waistline 20, the earlier front shoulder to waistline measurement is drawn from the shoulder seam 17' down to the waistline and marked on the grid 17 of the master pattern. Using the straight edge, the waistline is drawn on the top bodice. It is to be understood that the pattern permits ½ inch seam allowance. Therefore, it is necessary to add ½ inch to the measurement before marking on the tissue. Then fold up the skirt portion 16 along with the tissue to the waistline, and the remaining dots are connected to finish the dress side seam from the bottom of the bust dart to the waistline. From the waistline the curve and straight edges are used to connect the dots which form the skirt side seam. If a sharp angle is encountered, it is sometimes useful to use a smooth curve for blending of the waistline.

In the next step the hemline length is used to measure from the shoulder seam to the hem measurement. Again, a seam allowance must be added to this measurement. Drawing of the hemline is accomplished by using a slight curve at the side seam as shown at 35. The hem of the dress varies with regard to personal preference, usually from 2–3 inches.

The plastic tool is then used which has the straight edge 25 and curve 24, in the middle of which it has a waistline dart as shown at 36. Draw the waistline dart by lining up the base of the waistline marker with the waistline, and move the dart marker to the left or right until such time as the line from the dart point lines up with the new pivot point drawn in association with the bustline dart. Then flip the dart marker over to draw the bottom of the waistline dart on the skirt, which completes the front pattern. The back pattern is similarly completed except for the appropriate changes to the bustline.

To produce a skirt pattern from the tissue pattern, a waistine is used from the master pattern below, which curves slightly up as at 37 at the side seam, and then traced onto the tissue pattern to obtain the proper waistline contour.

For producing a back pattern the master pattern is placed on a hard surface, after which tissue is placed over the master. With the straight edge the center back 40 is drawn. Note that the center back line is the stitching line or fold line and not the cutting line. Now draw in the grain lines 41 for the bodice and 42 for the skirt. The top of the back bodice 43 is based upon bust measurement. Mark the dots on the tissue in accordance with the bust measurements at the neckline 44, shoulder seam 45, armhole 46 and the side seam 47.

At the waistline 48, shift to the waist measurement and continue marking the graded measurements at the high hip 49 and at the widest hip 50 and from there down to the hemline. All measurements are in accordance with the widest hip measurement.

Now use the curved portion to connect the dots of the graded measurements from the center back 40 to the shoulder seam 45. Draw three dots to connect shoulder dart 51. Complete drawing of the shoulder seam with the straight edge of the tool.

The back armhole 46 is drawn in two steps: Draw the top of the back armhole with one section of the curve by placing the indicated arrow on the curve at the armhole grid and align the curve to connect the dots from the said grid up to the shoulder seam 45. To draw the bottom of the back armhole, move the curve to line up position No. 2, as shown at 53, with the armhole grid, and align the curve to connect dots from the grid to the underarm seam. One must, of course, mark notches in the back armhole in order to line up the fabric in the sewing operation.

Following the above step, measure the front side seam of the pattern and subtract 2½ inches from this particular measurement, i.e. the width of the bust dart. This will be the length of the back side seam. Mark the length of the back side seam at the waistline grid.

To establish the back waist length, locate the natural fall of the waistline in relation to the front master pattern. In using the front waistline grid as a guide, mark and draw in the back waist length. Fold the skirt up to the waistline and draw in the dress side seam from the underarm 47 to the waistline 48. Then complete drawing of the pattern onto the tissue by using curves and straight edges to connect the graded measurements which are marked, enabling formation of the skirt side seam 55. Graded measurements are made on the basis of the widest hip measurement.

When encountering a sharp angle perhaps where the bodice and skirt come together at the waistline, it is desirable to use the curve to blend into a smooth curved line.

Mark the hemline length, remembering that the back seam length is the same as the front seam length from waist to hem. Measure the front seam length with a tape measure for correct back seam length, and draw the hemline by using the slight curve at the side seam. With the tool draw the waistline darts; line up the base of the waistline dart marker with the waistline drawn on the tissue. Move the dart marker to left or right until the back waistline dart is the same distance from the center front line. If it is desirable to move the front waistline dart over one inch, then move the back waistline dart over one inch by using the grid as a guide. Flip the dart marker over in order to draw the bottom of the waistline dart on the skirt. It should be noted that the dart marker marks only one side of the waistline guide enabling one to easily locate and mark the dart foldline. In garment construction, mark the dart foldline and stitching line for accurate dart placement in stitching. The back pattern is thus completed.

For the construction of sleeves, lay the tissue over the sleeve master pattern. Draw the center grain line 60 onto the tissue. Place dots on all grid measurement points in accordance with bust measurement, except for the dots that make the elbow dart. Beginning at the center of the sleeve cap, grid 61, use the tool to connect the first three dots on the front of the sleeve cap. Turn the tool upside down and connect the dots from the front notch grid to the dot on the underarm grid 62. Remember to mark the front sleeve cap with a single notch as at 63. Beginning at the center sleeve cap grid, use the tool to connect the three dots on the back of the sleeve cap. Turn the tool upside down, and connect the dot from the back notch grid to the dot on the underarm grid 64. Mark the back sleeve cap with a double notch as at 65. Mark the shoulder to elbow measurement on tissue by using the grain line as a guide. Draw the line through this mark from the side seam to side seam. This is known as the dart line.

The pattern includes a half inch seam allowance; therefore add a half inch to this measurement for marking on the tissue. Using the grain line on the master pattern as a track, move the tissue up or down until the grain line and the guide line, just drawn on tissue, matches up with the top stitching line of the elbow dart on the master pattern. Draw elbow dart 67 on tissue by tracing away three dots from the master pattern. Let the tissue fall back into place, and then draw in the elbow dart with the straight edge 24 of the tool. Mark the arm length on the grain line. This mark is known as the armlength point. Again, using the grain line on the master pattern as a track, move the tissue up or down until the armlength point, just drawn on the tissue, matches up with the armlength line broken line on the master pattern. Borrow the finished hemline from the master pattern, and trace onto tissue with the curve. Let the tissue fall back into place. Finish the sleeve by drawing the side seams.

The invention has been described with reference to a preferred embodiment. Obviously, modifications and alterations will occur to others upon the reading and understanding of this specification. It is the intent herein to include all such modifications and alterations insofar as they come within the scope of the appended claims or the equivalents thereof.

I claim:

1. A method of making a front dress pattern from a master pattern, said dress pattern including a bodice with peripheral sections such as a center front section, front neckline, a shoulder seam, front armhole, underarm seam, bust dart, and a skirt section, each of said sections having graded measurements thereon;

taking measurements of a women's bust, waistline, high hip, widest hip, front shoulder seam to waistline, front shoulder seam to hem, and pivot point to pivot point;

performing said method by means of a connection of marked dots over the graded measurements and using a straight-edge tool and one or more curves to facilitate matching of the armhole and neckline, comprising:

A. placing tissue over a master pattern;

B. marking the center front directly onto the tissue without any graded measurement;

C. marking dots over the graded measurement onto said tissue over the bodice and in accordance with a particular bust measurement;

D. marking dots over the graded measurements onto said tissue over the skirt section, including the waist, high hip, and widest hip, in accordance with each of said measurements; and E. connecting dots and using matching curves wherever appropriate.

2. The method of claim 1 wherein the armhole has a graded measurement and additional graded measurements on either side for the shoulder seam and the underarm seam, which are comprised of connecting dots, and using one section of a curve for one portion of the armhole and another section of the curve for the other portion of said armhole.

3. The method of claim 1 in which the master pattern is formed in two separate pieces but adjacent one from another, comprising forming of a bodice section and a separate skirt section, and then folding the master pattern and tissue over at the line marked by the shoulder seam to waistline dimension.

4. The method of claim 1 in which graded measurements are marked on the bust dart and the pivot point to establish and complete the bust dart.

* * * * *